United States Patent [19]

Hall

[11] Patent Number: 4,573,189

[45] Date of Patent: Feb. 25, 1986

[54] LOUDSPEAKER WITH HIGH FREQUENCY MOTIONAL FEEDBACK

[75] Inventor: David S. Hall, Palo Alto, Calif.

[73] Assignee: Velodyne Acoustics, Inc., Santa Clara, Calif.

[21] Appl. No.: 543,375

[22] Filed: Oct. 19, 1983

[51] Int. Cl.[4] ..... H04R 3/00

[52] U.S. Cl. ..... 381/96; 381/59; 179/115.5 VC

[58] Field of Search ..... 381/96, 59; 84/DIG. 2; 179/115.5 R, 115.5 VC; 310/331, 338

[56] References Cited

U.S. PATENT DOCUMENTS

| | | | |
|---|---|---|---|
| 3,525,812 | 8/1970 | Verdier | 381/96 |
| 3,530,244 | 9/1970 | Reiffin | 381/96 |
| 3,941,932 | 3/1976 | D'Hoogh | 381/96 |
| 4,180,706 | 12/1979 | Bakgaard . | |
| 4,207,430 | 6/1980 | Harada et al. . | |
| 4,243,839 | 1/1981 | Takahashi et al. . | |
| 4,256,923 | 3/1981 | Meyers . | |
| 4,276,443 | 6/1981 | Meyers . | |

FOREIGN PATENT DOCUMENTS

| | | | |
|---|---|---|---|
| 1563226 | 3/1980 | United Kingdom | 84/DIG. 24 |

*Primary Examiner*—Forester W. Isen

*Attorney, Agent, or Firm*—Parmelee, Bollinger & Bramblett

[57] ABSTRACT

A moving-coil loudspeaker system incorporating motional feedback operable at high frequencies, i.e. above about 1000 Hz. The feedback signal is developed by a tiny piezo-electric accelerometer mounted together with a charge amplifier directly on the loudspeaker coil, in alignment with the turns of the coil. The coil comprises two layers of rectangular, anodized aluminum wire wound tightly to form an effectively integral mass. The system includes a suitable stabilizing frequency compensation network.

35 Claims, 10 Drawing Figures

LOUDSPEAKER WITH HIGH FREQUENCY MOTIONAL FEEDBACK

BACKGROUND OF THE INVENTION

1. Field of the Invention

This invention relates to sound reproduction. More particularly, this invention relates to high fidelity loudspeaker systems capable of faithfully reproducing sound signals over a wide range of frequencies.

2. Prior Art

A great variety of loudspeaker designs have been proposed for high quality sound reproduction, and a number have gone into commercial use. Typically, modern systems utilize different speakers for different segments of the sound spectrum, e.g. a so-called "woofer" for bass, a midrange speaker for intermediate frequencies, and a so-called "tweeter" for the very high frequencies.

The use of "motional feedback" wherein the motion of the cone in an electrodynamic loudspeaker is transduced, inverted, and fed back to the summing point of a control loop is well known. The object of such control has been to provide an improvement of the bass reproduction by the loudspeaker and a reduction in acoustic wave form distortion.

It is generally accepted that loudspeakers of sufficient size to produce adequate bass do not reproduce well at high frequencies. Breakup of the cone into standing waves, as well as beaming and other directional effects cause poor sounding reproduction to result when a "full range" loudspeaker is attempted. For these reasons, in high fidelity speaker systems a separate mid-range and possibly a tweeter are used even when motional feedback is applied to the woofer.

SUMMARY OF THE INVENTION

It has been found that, contrary to conventional audio design concepts, greatly superior results are achieved by the use of motional feedback at high frequencies. By extending the useful open loop feedback gain to frequencies above about 1000 Hz, a single loudspeaker so controlled performs as an excellent full-range speaker. An unusual clarity and pleasant balance of the sound is achieved. It is especially surprising to hear smooth and clear high frequency segments, usually reproduced by a tweeter, emanating from a loudspeaker large enough to simultaneously perform as a woofer.

At frequencies above 1000 HZ or so, the cone will tend to decouple from the voice coil. Sometimes it is said that the cone "breaks up", meaning that the cone no longer acts as a simple piston, moving in unison with the coil. In the case of large speakers, 8 to 10 inches in diameter, or so, cone break-up typically will occur somewhat below 1000 Hz, e.g. about 800 Hz. In small speakers 4 to 6 inches in diameter, cone break-up might occur near 1500 Hz. In this specification, the frequency of cone break-up is said to be about 1000 Hz, to encompass the practical range of values.

It is widely believed, in fact prior art teaches, that application of motional feedback is useless above the frequency where cone break-up occurs. It has been found that, contrary to previous belief, when motional feedback is used to directly control the motion of the coil, excellent improvement in sound quality results even at frequencies well above 1000 Hz.

Accordingly, it is an object of the invention to provide an improved loudspeaker system capable of high quality wide-range sound reproduction. A more specific object of the invention is to provide a single loudspeaker with the capability of reproducing both low and high frequencies. Still other objects, aspects and advantages of the invention will in part be pointed out in, and in part apparent from the following description of a presently preferred embodiment of the invention, considered together with the accompanying drawings.

DESCRIPTION OF THE PREFERRED EMBODIMENT

Figure 1:
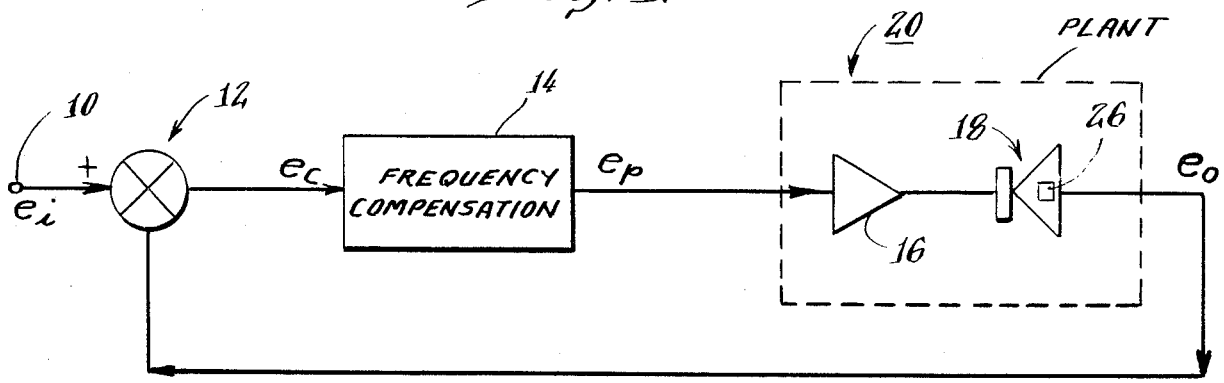
FIG. 1 is a block diagram of a loudspeaker system in accordance with the present invention.

Referring first to FIG. 1, the complete loudspeaker system comprises the usual input terminal 10 receiving the input drive voltage $e_i$ representing the sound signal to be reproduced. This voltage is applied to a summing point generally indicated at 12. The output of the summing point is fed as a voltage labelled $e_c$ to a frequency compensation network 14. The output signal of this network $e_p$ drives a power amplifier 16 and loudspeaker 18. The latter two components (together with an associated transducer) are referred to in composite as the "plant" 20.

Figure 2:
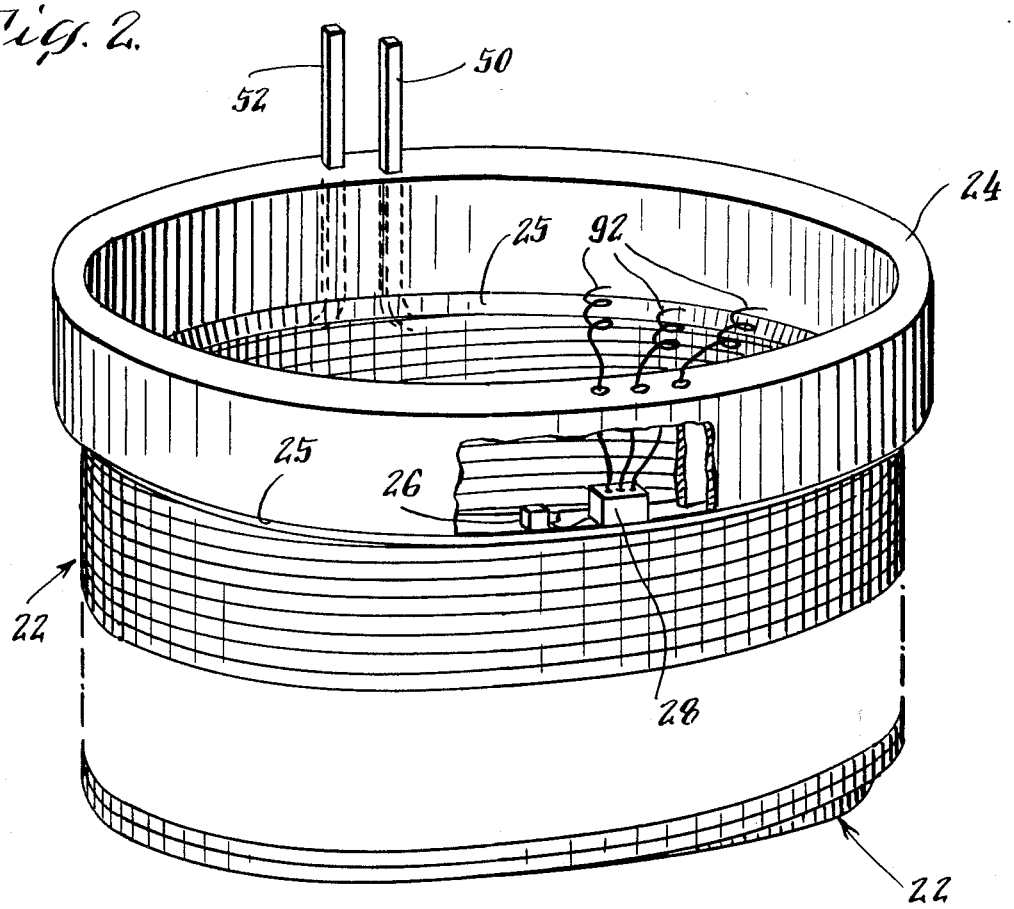
FIG. 2 is a perspective view of the loudspeaker coil arrangement broken away to show the accelerometer pick-up device.

Referring also to FIG. 2, the loudspeaker coil 22 carries a conductive shield ring 24 having a cross-section in the form of an inverted U-shape and which surrounds a tiny transducer in the form of a motion-sensing element, specifically comprising an accelerometer 26, and an associated charge amplifier 28. This accelerometer/amplifier combination produces the output voltage $e_o$ of the plant 20. This output voltage $e_o$ is degeneratively fed back to the summing point 12 where it is summed with the input drive voltage $e_i$.

Figure 3:
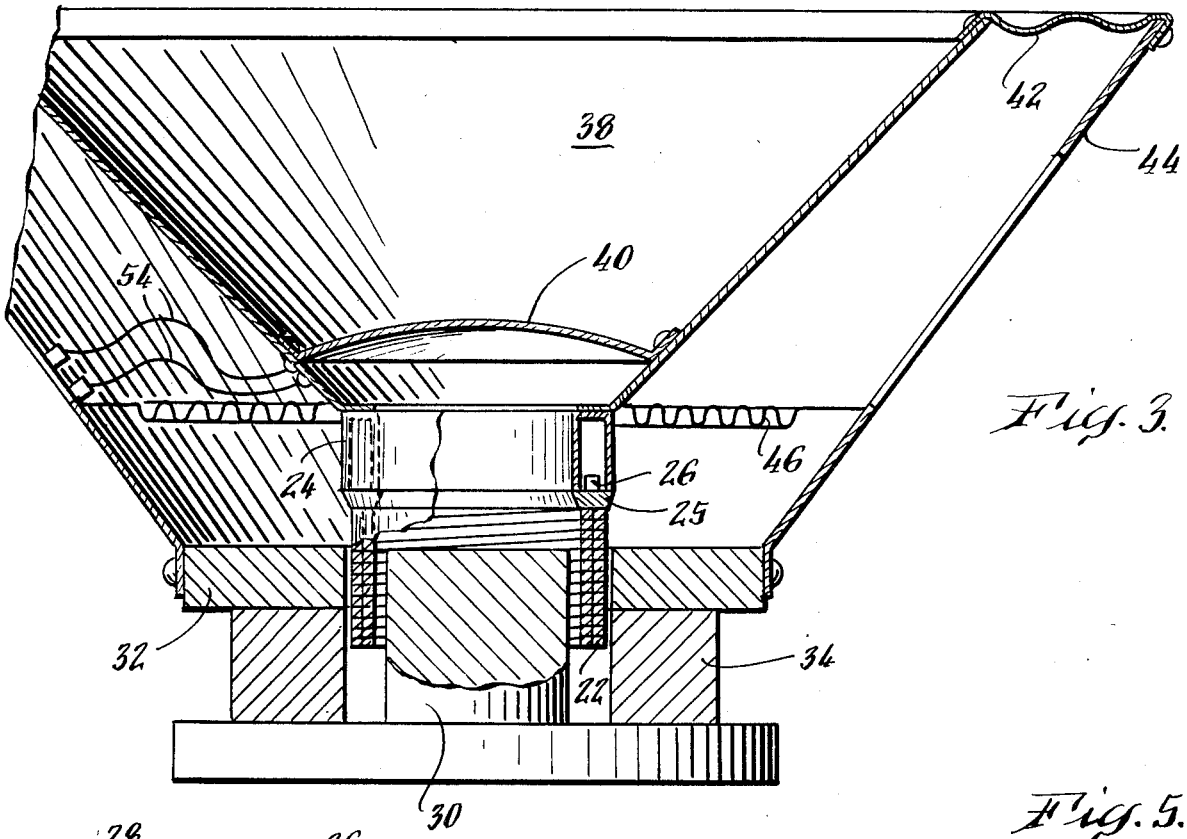
FIG. 3 is a cross-sectional view of the loudspeaker.
Figure 4:
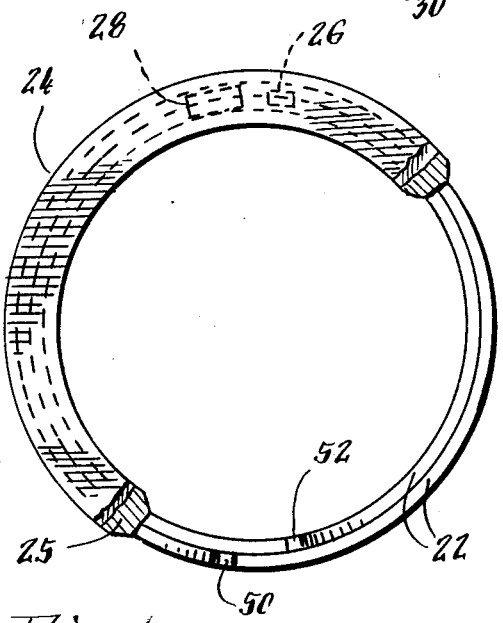
FIG. 4 is a plan view, partly broken away, of the shield-ring for the coil.
Figure 5:
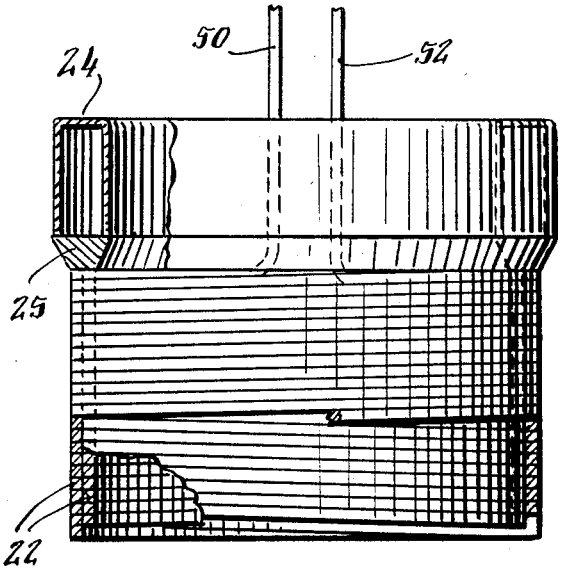
FIG. 5 is a detailed section view of the coil construction.

Referring now to FIGS. 3 through 5, the coil 22 is positioned in an air-gap between a magnetic pole piece 30 and a magnetic strip 32 supplied with flux by a ring magnet 34. The shield ring 24 is secured firmly to a conductive shorting ring 25 attached to the end of the coil. The accelerometer 26 rests securely upon and is affixed to the shorting ring 25. The accelerometer 26 is entirely surrounded by the structure formed by the shorting ring 25 and the adjacent side walls and top of the shield ring 24. The conductive shorting ring and shield ring prevent stray magnetic or electric fields from inducing currents in the wires associated with the accelerometer.

The loudspeaker cone 38 together with its dustcap 40 is secured to the shield ring 24. The outer end of the cone is connected by the usual flexible "surround" material 42 to the rigid basket 44 of the loudspeaker. A conventional spider 46 holds the coil in proper alignment as it moves in the air gap.

To minimize propagation delay time between the coil 22 and the transducer 26, and to increase the resonant frequency of the coil-transducer system, the coil is arranged to serve essentially as an integral body when acted upon by forces due to current in the coil. In the preferred embodiment, for this purpose, the coil is tightly wound from rectangular aluminum wire, insulated with a rigid insulation, e.g. in the form of glass or anodized aluminum. The coil comprises inner and outer sections, wound in opposite directions, and connected together at the bottom. The top ends 50, 52 of the two coil sections pass up through the shorting ring 25 and the shield-ring 24 and connect to leads 54 passing through the cone to terminals provided in known manner on the basket 44. For some applications, the coil 22 can be a single layer of wire.

Figure 7:
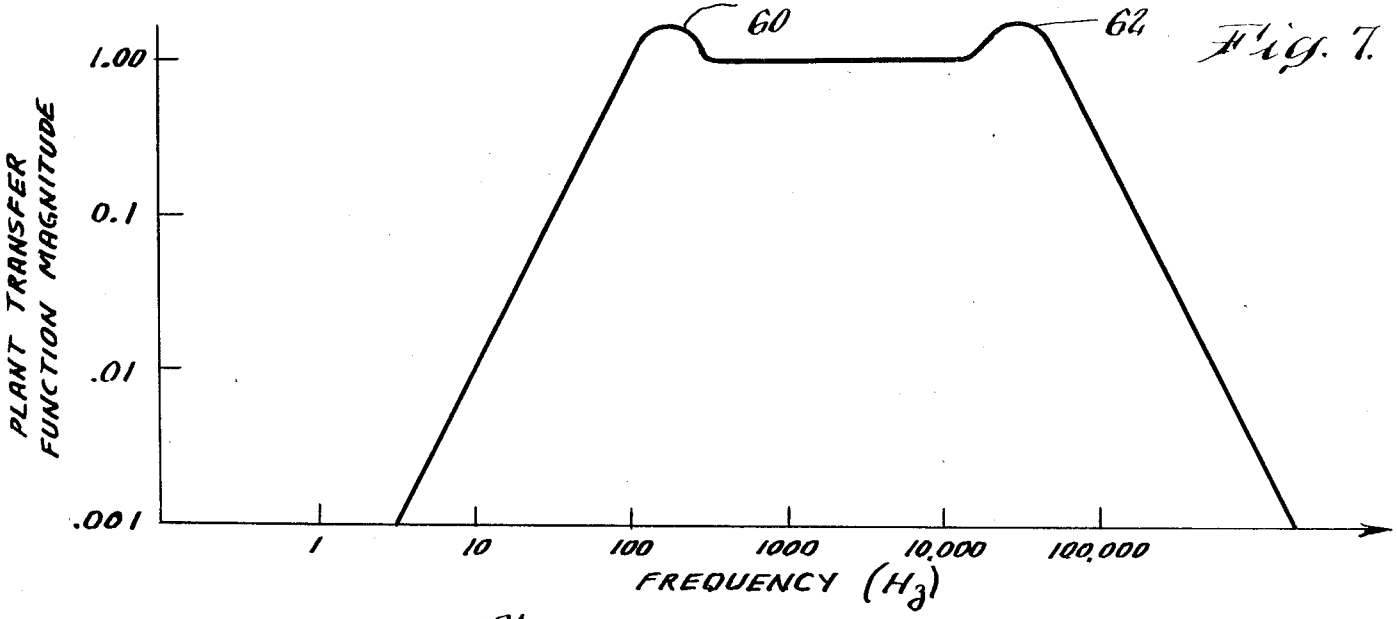
FIGS. 7 through 10 are graphs illustrating frequency-response characteristics of the system.

FIG. 7 shows a magnitude plot for the transfer function of the plant 20. With $e_p$ as the input drive voltage to the plant and $e_o$ as the amplified output volage from the accelerometer 26, FIG. 7 presents a log-log plot of magnitude ($e_o/e_p$) vs. frequency.

The plant 20 can be considered to be a simple second-order high-pass system at low frequencies. Above the low frequency resonance 60 at about 150 Hz, the plant's output is essentially flat until about 40 KHz. The peak 62 at 40 KHz is due to resonance of the piezo-electric transducer used in the accelerometer 26. A phase lead of 180° occuring below 150 Hz and a phase lag of 180° occuring above 40 KHz can cause loop instability, and should be avoided.

Figure 8:
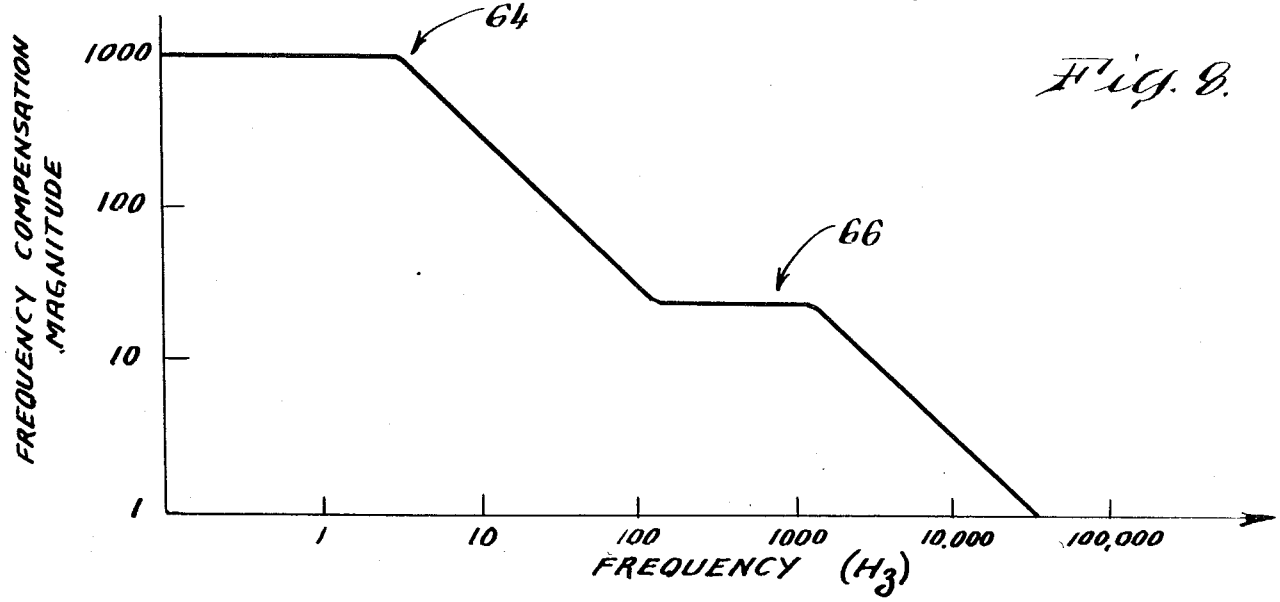

FIG. 8 shows a magnitude plot for the transfer function of the frequency compensation network 14. With $e_c$ as the input to the compensation network and $e_p$ as the output of the compensation network, FIG. 8 presents a log-log plot of magnitude ($e_p/e_c$) vs. frequency. The compensation network is essentially a simple pole 64 inserted into the loop at about 5 Hz. This integration is interrupted by a lead compensator 66 acting between 200 Hz and 2000 Hz.

Figure 9:
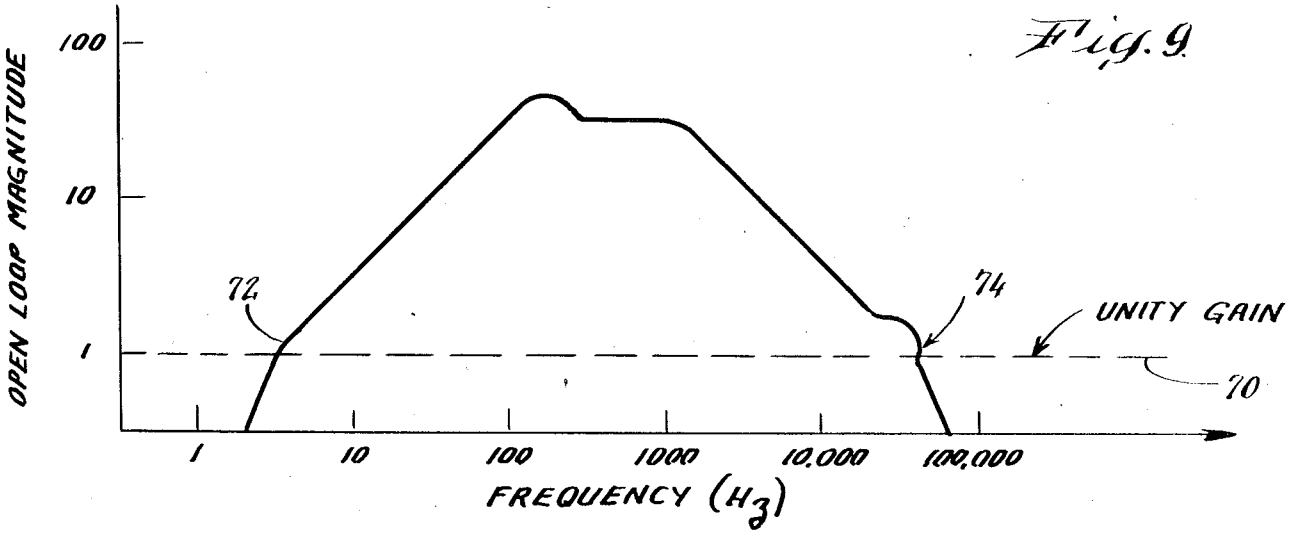

FIG. 9 presents the open loop transfer function magnitude plot. With $e_i$ as the input to the loop and $e_o$ as the output of the plant, FIG. 9 provides a log-log plot of magnitude ($e_i/e_o$) vs. frequency with the loop open, i.e. before the connection is made to subtract the output from the input at the summing point 12. The unity gain line 70 is shown for reference. There is a low frequency unity gain crossover point 72 at about 5 Hz and a high-frequency unity gain crossover point 74 at about 40 KHz.

Figure 10:
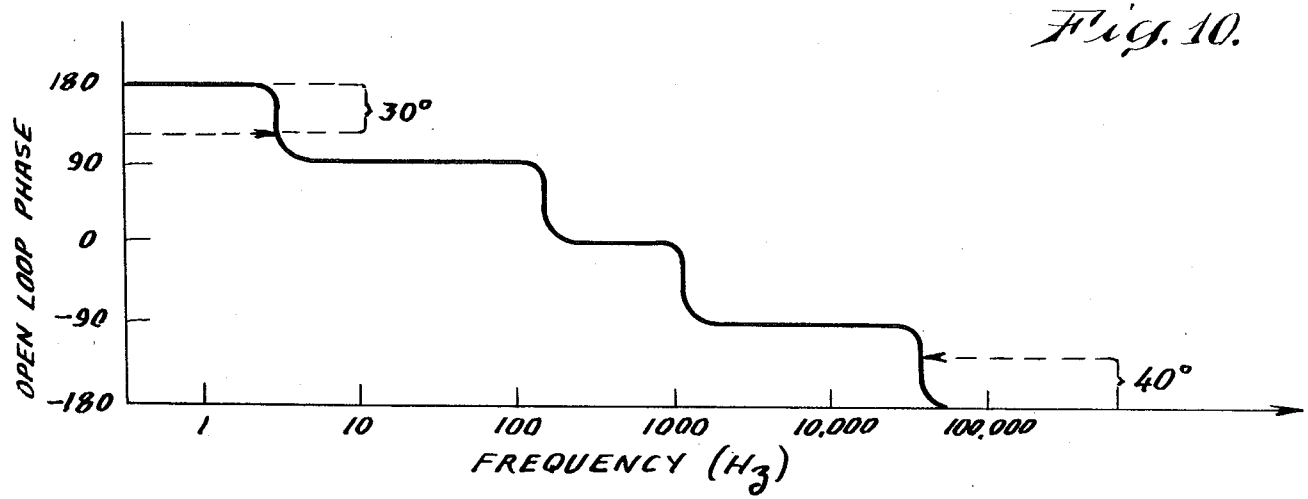

FIG. 10 shows the corresponding phase plot for the open loop transfer function. The phase margin at the low frequency unity gain crossover point 72 is about 30°, as shown in dotted line on the drawing. The phase margin at the high frequency unity gain crossover point 74 is about 40°.

In accordance with important aspects of the invention, the frequency at which the open loop gain is in excess of unity, and associated open loop phase angle less than 180°, should be at least about 1000 Hz, and preferably is well in excess of that figure. For example, this upper frequency limit can with advantage reach 20,000 Hz or above, as shown in FIG. 9, so as to provide effective control over the entire audio spectrum.

Figure 6:
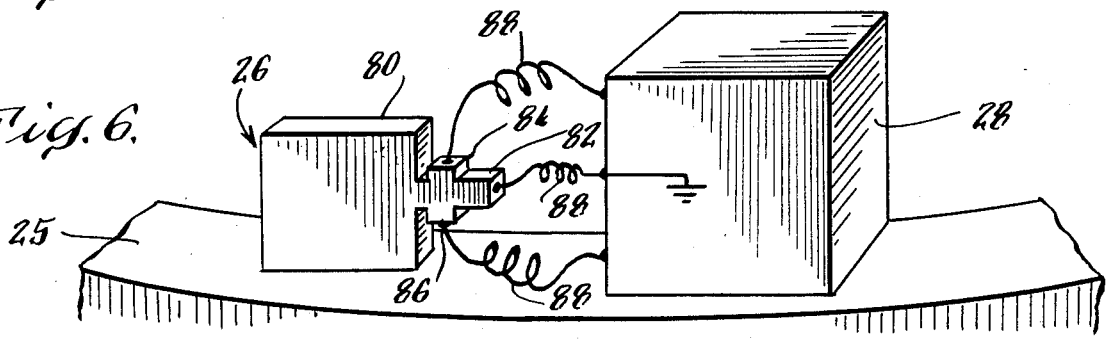
FIG. 6 is a pictorial presentation of the accelerometer pick-up and its associated charge or voltage amplifier.

Referring now to FIG. 6, the force transducer 26 used as the motion-sensing element in a high-frequency motional feedback system comprises a small block 80 formed for example of aluminum or ceramic, and including a cantilever-like beam 82 with a degree of flexibility to permit it to swing up and down a small amount in response to movements of the coil 22. Secured on the top and bottom surfaces of this beam are piezo-electric elements 84, 86 which generate electrical output signals responsive to the flexing movement of the beam. The piezo-electric elements are connected by lead wires 88 to the charge amplifier 28 mounted adjacent to the force transducer (accelerometer). The piezo-electric elements may be formed of piezo-ceramic materials such as lead zirconium titanate or quartz used for such purposes. Alternatively, the force-sensing elements could be piezo-resistive.

The force transducer preferably is arranged so that its center of gravity is in line with, i.e. directly above, the top of the coil 22, thereby supported by a simple column of material joining the coil and transducer. This is superior to placing the transducer at the apex of the cone or in the center of the coil, where the resulting cantilever support will tend to resonate at too low a frequency to allow high frequency control.

In the disclosed embodiment, the output $e_o$ of the charge amplifier 28 is proportional to the acceleration of the piezo-electric elements 84, 86. This amplifier can be of known construction, serving as an operational amplifier. Its input can utilize FET devices in known fashion. The size and mass of the piezo-electric elements and the associated charge amplifier should, however, be kept small to ensure that the resonant frequencies of the entire moving structure will be as high as possible.

The shield-ring 24 serves as a shield for the force transducer 26. The amplifier power supply and output signal leads 92 (shown in abbreviated pictorial form in FIG. 2) pass through holes in the shield-ring and thence, in known fashion, through the cone 38 to terminals on the basket 44. Details of such connections are not shown because they are well known to those familiar with this art.

It will be seen that no attempt has been made to directly control the motion of the cone by directly transducing the cone motion and feeding it back. Such information is simply too "old" to be of utility at frequencies above about 1000 Hz. Instead, the motion of the coil is controlled directly.

Although a specific preferred embodiment of this invention has been described hereinabove in detail, it is desired to emphasize that this has been for the purpose of illustrating the invention, and should not be considered as necessarily limitative of the invention, it being understood that many modifications can be made by those skilled in the art while still practicing the invention claimed herein.

What is claimed is:

1. In a loudspeaker of the moving-coil type, the combination of:

a motional transducer element rigidly secured to the moving coil of said loudspeaker;

negative feedback means coupled to said transducer to direct the transducer signal to a summing point together with a loudspeaker audio signal to form a closed feedback loop;

an amplifier having its input coupled to said summing point and its output driving said moving coil;

said feedback loop providing an open loop gain in excess of unity and a phase angle less than 180° at a frequency in excess of about 1000 Hz.

2. The loudspeaker of claim 1, wherein said coil is wound from wire insulated by a rigid material to ensure that said coil moves as a substantially solid mass of material.

3. The loudspeaker of claim 2, wherein said coil is wound from substantially rectangular aluminum wire, said wire being anodized and tightly wound to ensure that said coil moves as a substantially solid mass of material.

4. The loudspeaker of claim 2, wherein said coil is wound from wire insulated by glass and is tightly wound to ensure that said coil moves as a substantially solid mass of material.

5. The loudspeaker of claim 1, wherein said open loop gain is in excess of unity at a frequency in excess of 3,000 Hz.

6. The loudspeaker of claim 5, wherein said open loop gain is in excess of unity at a frequency in excess of 10,000 Hz.

7. The loudspeaker of claim 1, wherein said transducer is positioned with its center of gravity directly in line with the windings of said coil and effectively supported upon one end of said windings by a simple column of material.

8. The loudspeaker of claim 7, wherein said motional transducer is an accelerometer.

9. The loudspeaker of claim 8, wherein the force-sensing element of said accelerometer is a piezo-electric element.

10. The loudspeaker of claim 9, wherein the piezo-electric element is quartz.

11. The loudspeaker of claim 9, wherein the piezo-electric element is a piezo-ceramic.

12. The loudspeaker of claim 7, wherein said transducer is mounted upon and firmly attached to a circular shorting ring secured to one end of said voice coil and holding said transducer in close proximity to said coil;

said shorting ring being highly conductive to effectively prevent magnetic coupling between said coil and said transducer.

13. The loudspeaker of claim 12, wherein said transducer is mounted within a conductive shielding ring;

said shielding ring being firmly attached to said shorting ring and enclosing said transducer.

14. The loudspeaker of claim 1, wherein said transducer comprises support means from which a cantilever beam protrudes;

piezo-electric means attached to and supported by said beam;

said piezo-electric means comprising a pair of elements which are substantially identical and on opposite sides of said beam;

said elements being aligned along a line parallel to the axis of movement of said voice coil; and means connecting said piezo-electric elements together to said amplifier.

15. The loudspeaker of claim 14, wherein said block is composed of aluminum.

16. The loudspeaker of claim 14, wherein said support means comprises a block composed of a ceramic material.

17. The loudspeaker of claim 1, wherein said coil comprises an inner and an outer layer of wire.

18. The loudspeaker of claim 1, including an amplifier mounted adjacent to and moving with said motional transducer and receiving the output of said transducer.

19. The loudspeaker of claim 18, wherein said amplifier includes an FET device.

20. The loudspeaker of claim 18, wherein both said transducer and said amplifier are enclosed within a conductive cylindrical end ring serving as a shield and a shorting ring.

21. In a loudspeaker of the moving-coil type, the combination of:

a motional transducer element secured to the moving coil of said loudspeaker;

negative feedback means coupled to said transducer to combine the transducer signal with a loudspeaker audio signal to form a closed feedback loop;

an amplifier having its input coupled to the composite of transducer and audio signals, the output of said amplifier driving said moving coil;

said feedback loop providing an open loop gain in excess of unity and a phase angle less than 180° at a frequency in excess of the cone break-up frequency of said loudspeaker.

22. In a loudspeaker of the moving-coil type, the combination of:

a motional transducer element secured to the moving coil of said loudspeaker and having its center of gravity directly in line with the windings of said coil at one end thereof;

negative feedback means coupled to said transducer to combine the transducer signal with a loudspeaker audio signal to form a closed feedback loop; and an amplifier having its input coupled to the composite of transducer and audio signals, the output of said amplifier drving said moving coil;

said coil being wound from wire insulated with a rigid material to ensure that the coil moves as a substantially solid mass of material.

23. In a loudspeaker of the moving-coil type, the combination of:

a motional transducer element secured to the moving coil of said loudspeaker;

negative feedback means coupled to said transducer to combine the transducer signal with a loudspeaker audio signal to form a closed feedback loop;

an amplifier having its input coupled to the composite of transducer and audio signals, the output of said amplifier driving said moving coil;

said coil being tightly wound from rigid wire having a rectangular cross-section, adjacent turns of said wire being aligned face-to-face so that the coil is an effectively solid mass of wire material.

24. The loudspeaker of claim 23, wherein said coil is wound from wire insulated with glass.

25. In a loudspeaker of the moving-coil type, the combination of:

a motional transducer element secured to the moving coil of said loudspeaker;

said transducer element being positioned with its center of gravity aligned with the mass of the windings of said coil and rigidly supported upon said coil windings to assure movement therewith without significant time delays;

negative feedback means coupled to said transducer to combine the transducer signal with a loudspeaker audio signal to form a closed feedback loop; and an amplifier having its input coupled to the composite of transducer and audio signals, the output of said amplifier driving said moving coil.

26. The loudspeaker of claim 25, wherein said coil is in a cylindrical form;

said transducer element being positioned in a region representing an extension of said cylindrical coil in a direction parallel to the cylindrical axis.

27. The loudspeaker of claim 26, wherein said transducer comprises a cantilever beam extending in a direction which is tangential with respect to said cylindrical coil.

28. The loudspeaker of claim 27, including a pair of motion-responsive elements secured to said beam on opposite sides thereof, said elements being spatially aligned along a line parallel to said cylindrical axis.

29. In a loudspeaker of the moving-coil type, the combination of:

a motional transducer secured to the moving coil of said loudspeaker;

said transducer comprising a support with a cantilever beam swingable about said support in response to movements of the coil;

means secured to said beam to produce an output signal responsive to beam movement;

said movement-responsive means comprising a pair of sensing elements mounted on opposite sides of said beam and spatially positioned along a line parallel to the axis of movement of said coil to produce a combined signal responsive thereto;

negative feedback means coupled to said transducer to combine the transducer output signal with a loudspeaker audio signal to form a closed feedback loop; and an amplifier having its input coupled to the composite of transducer and audio signals, the output of said amplifier driving said moving coil.

30. The loudspeaker of claim 29, wherein said elements are piezo-electric devices.

31. In a loudspeaker of the moving-coil type, the combination of:

a motional transducer element secured to the moving coil of said loudspeaker;

a circular shorting ring of conductive material secured to one end of said coil between said coil and said transducer element;

said shorting ring preventing magnetic coupling between said coil and said transducer;

negative feedback means coupled to said transducer to direct the transducer signal to a summing point together with a loudspeaker audio signal to form a closed feedback loop; and an amplifier having its input coupled to said summing point and its output driving said moving coil.

32. The loudspeaker of claim 31, including conductive shielding means surrounding said transducer element.

33. The loudspeaker of claim 32, wherein said shielding means comprises a structure contiguous with said shorting ring and extending around the end of said coil with said shorting ring.

34. The loudspeaker of claim 33, wherein said structure has a box-like cross-section within which said transducer element is positioned.

35. The loudspeaker of claim 32, including an amplifier located next to said transducer element and connected thereto;

both said transducer element and said amplifier being located within the confines of said shielding means.

* * * * *